US006553582B1

(12) United States Patent
Clark

(10) Patent No.: US 6,553,582 B1
(45) Date of Patent: Apr. 29, 2003

(54) ADJUSTABLE TOILET BOWL SYSTEM

(76) Inventor: Moses Clark, 300 Yoakum Pkwy., Apt. 1522, Alexandria, VA (US) 22304-4064

( * ) Notice: Subject to any disclaimer, the term of this patent is extended or adjusted under 35 U.S.C. 154(b) by 0 days.

(21) Appl. No.: 10/059,403

(22) Filed: Jan. 31, 2002

(51) Int. Cl.[7] ..... E03D 11/00
(52) U.S. Cl. ..... 4/252.2
(58) Field of Search ..... 4/254, 667, 252.2, 4/312, 420

(56) References Cited

U.S. PATENT DOCUMENTS

| | | | | | |
|---|---|---|---|---|---|
| 1,067,767 | A | | 7/1913 | Simonson | 4/254 |
| 2,122,832 | A | | 7/1938 | Bentz | 4/254 |
| 4,091,473 | A | * | 5/1978 | Matthews et al. | 4/420 |
| 4,168,552 | A | | 9/1979 | Austin | 4/667 |
| 4,174,546 | A | * | 11/1979 | Ohtake | 4/420 |
| 4,441,218 | A | * | 4/1984 | Trybom | 4/252.2 |
| 4,635,303 | A | | 1/1987 | Shih | 4/254 |
| 4,726,079 | A | | 2/1988 | Signori et al. | 4/420 |
| 5,063,617 | A | * | 11/1991 | Ward et al. | 4/667 |
| 5,090,069 | A | * | 2/1992 | Decaux | 4/312 X |
| 5,553,334 | A | | 9/1996 | Hillman | 4/254 X |
| 6,199,228 | B1 | | 3/2001 | Kallweit | 4/667 |

* cited by examiner

*Primary Examiner*—Robert M. Fetsuga
(74) *Attorney, Agent, or Firm*—Donald R. Schoonover

(57) ABSTRACT

A toilet bowl is adjustable in a plurality of planes so it can be tilted with respect to a floor whereby a physically impaired person can have easy access to the toilet bowl. A plurality of independently operable toilet bowl lifting mechanisms each engage the toilet bowl and a fluid control circuit controls operation of the lifting mechanisms. A remote control unit controls operation of the fluid control circuit.

4 Claims, 3 Drawing Sheets

ADJUSTABLE TOILET BOWL SYSTEM

BACKGROUND OF THE INVENTION

1. Field of the Invention

The present invention relates to the general art of baths, closets and sinks, and to the particular field of flush closets.

2. Discussion of the Related Art

Difficulties associated with using a toilet is often not even considered by many people. However, there is a substantial segment of the population for which using a toilet is a difficult and daunting task. This segment of the population includes the physically challenged as well as those recuperating from various types of surgical operations and procedures.

Because of this, the art contains many examples of toilets designed for use by the physically challenged. Some of these toilets have railings which are grasped, some have platforms which elevate the user, and some have the ability to move up or down.

However, toilets that simply include support rails do not fulfill the needs of those that are unable to lift themselves or are unsteady if they do stand up.

Therefore, there is a need for an adjustable toilet that is able to meet the needs of all physically challenged people.

Still further, many known adjustable toilets are bulky, difficult to use and require a great deal of equipment. Such toilets are not generally amenable for use in an individual's home and may not be amenable for use in many institutions that may have limited space.

Therefore, there is a need for an adjustable toilet that is easy to use and is amenable for use in a variety of situations.

Still further, some of the known adjustable toilets cannot be readily retrofit into an existing system. That is, an existing toilet system may have to be completely-removed and totally replaced by the adjustable toilet system. This can be difficult, expensive and time consuming. It may not be possible in an individual's home.

Therefore, there is a need for an adjustable toilet that can be retrofit into an existing toilet system.

Still further, some adjustable toilets are not stable and may raise the possibility that a user may fall off of the toilet during use. This is especially true if the user is infirm and has impaired balance.

Therefore, there is a need for an adjustable toilet that is stable and can be easily and securely used, even by an infirm person.

Furthermore, many impaired persons can only reach a portion of a toilet seat. That is, most, if not all, existing toilet systems include a toilet seat that is oriented in a plane that is essentially parallel to the plane of the floor. With a toilet seat in such an orientation, a user must physically lift himself or herself over the plane of the toilet seat and then sit down on the seat. Many users are physically impaired in a manner that makes this difficult if not impossible. Such users are left to wriggle up onto the seat, which is inconvenient and may not be possible without assistance.

Therefore, there is a need for an adjustable toilet that can be tilted as necessary to permit use by a physically impaired individual.

PRINCIPAL OBJECTS OF THE INVENTION

It is a main object of the present invention to provide an adjustable toilet that is easy to use and is amenable for use in a variety of situations.

It is another object of the present invention to provide an adjustable toilet that can be retrofit into an existing toilet system.

It is another object of the present invention to provide an adjustable toilet that is stable and can be easily and securely used, even by an infirm person.

It is another object of the present invention to provide an adjustable toilet that can be tilted as necessary to permit use by a physically impaired individual.

SUMMARY OF THE INVENTION

These, and other, objects are achieved by an adjustable toilet which comprises a fresh water tank fixed to a support; a waste water conduit fixed to a floor, a toilet bowl having a fresh water inlet and a waste water outlet, a flexible fresh water conduit fluidically connecting the fresh water tank to the fresh water inlet of the toilet bowl, a flexible waste water conduit fluidically connecting the waste water outlet of the toilet bowl to the waste water conduit, a toilet bowl support system including a plurality of individually adjustable toilet bowl supports each of which has one end attached to the floor and another end attached to the toilet bowl, and a control circuit, associated with each of the individually adjustable toilet bowl supports to move each toilet bowl support independently of other toilet bowl supports to move the toilet bowl in a plurality of planes and to tilt the toilet bowl with respect to the floor into an oblique angle with respect to the floor.

The adjustable toilet of the present invention can thus be easily retrofit into an existing system and yet can adopt an orientation and position that is most effective for an individual user. The adjustable toilet of the present invention can be adjusted in a multiplicity of planes, including a plane that is tilted at an oblique angle with respect to the floor, whereby the toilet system can be customized for each individual and each use.

More specifically, the adjustable toilet bowl of the present invention includes a flexible fresh water conduit fluidically connecting the fresh water tank to the fresh water inlet of the toilet bowl and a flexible waste water conduit fluidically connecting the waste water outlet of the toilet bowl to the waste water conduit. Each of the toilet bowl lifting mechanisms more specifically includes a hydraulic cylinder having a hollow housing having an inside surface and a chamber defined by the inside surface, a first hydraulic fluid connection on the hollow housing, and a second hydraulic fluid connection on the hollow housing. Each lifting mechanism further includes a piston head movably located in the hollow housing and slidably engaging the inside surface of the hollow housing and dividing the chamber of the hollow housing into two chamber sections and a piston rod having one end connected to the piston head and extending out of the hollow housing and having a second end located outside the hollow housing. A floor pivot mount is fixedly mounted on the floor adjacent to the toilet bowl, and a floor pivot connection pivotably connects the second end of the piston rod to the floor pivot mount. A toilet bowl pivot connection pivotably connects the hollow housing to the toilet bowl, and the hydraulic cylinders are controlled by a hydraulic fluid circuit which includes a reservoir of hydraulic fluid, a pump fluidically connected to the reservoir, a first hydraulic fluid conduit system fluidically connecting the pump to the first hydraulic fluid connection of the hollow housing of each toilet bowl lifting mechanism, a first hydraulic fluid flow control valve in each first hydraulic fluid conduit and located fluidically between the pump and the hollow housing, a second hydraulic fluid conduit system fluidically connecting the.second hydraulic fluid connection of the hollow housing of each, toilet bowl lifting mechanism to the pump, and a second hydraulic fluid flow control valve in each second hydraulic fluid conduit and located fluidically between the hollow housing and the pump. A control circuit electrically associates the pump with each hydraulic fluid control valve and which includes a remote control unit.

DETAILED DESCRIPTION OF THE INVENTION

Other objects, features and advantages of the invention will become apparent from a consideration of the following detailed description and the accompanying drawings.

The adjustable toilet of the present invention can be adjusted in a multiplicity of planes and angles so it can be adjusted to fit the particular needs of the individual using the toilet. Specifically, the toilet can be tilted as needed to permit use.

Figure 1:
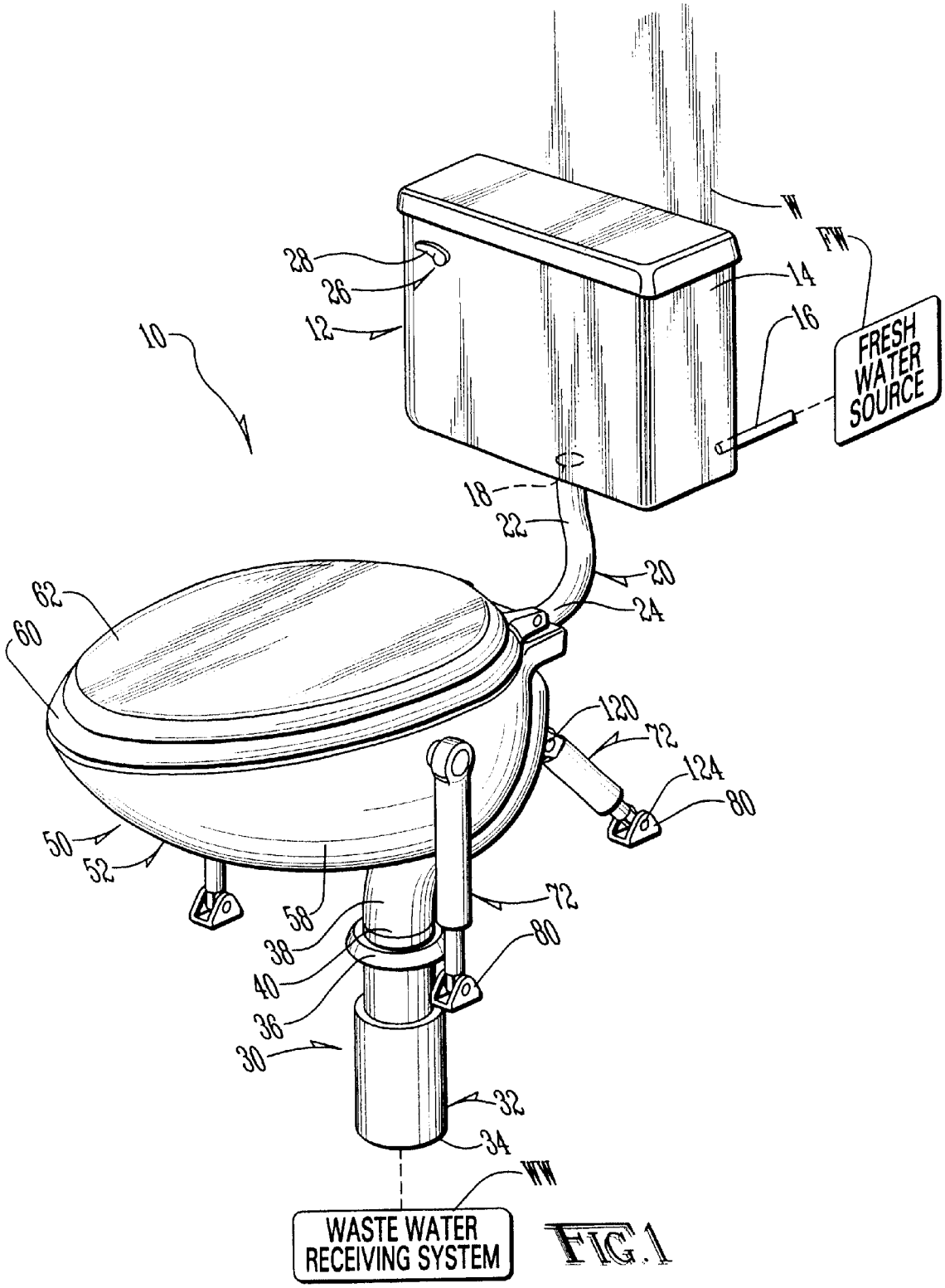
FIG. 1 is a perspective view of an adjustable toilet embodying the present invention.
Figure 2:
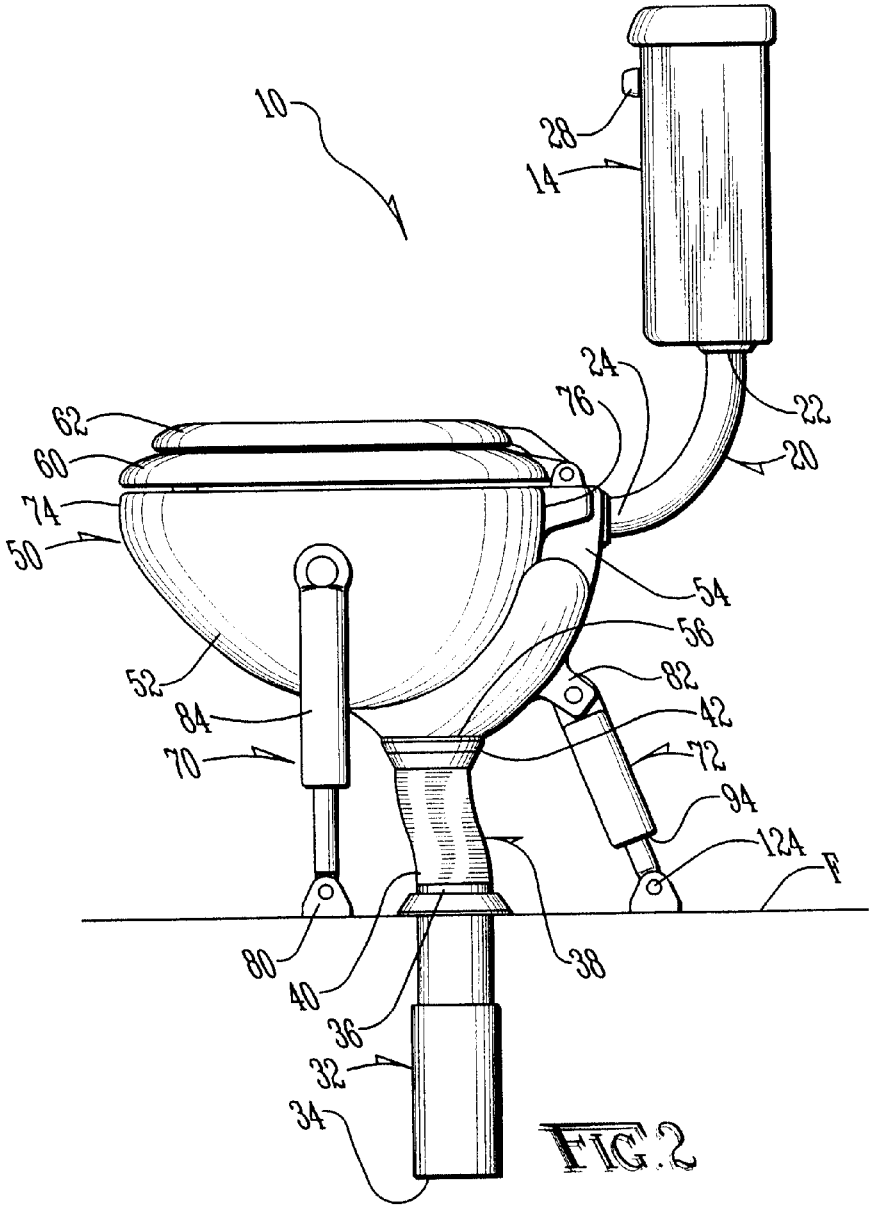
FIG. 2 is a side elevational view of the adjustable toilet of the present invention.

Referring to FIGS. 1 and 2, it can be seen that the present invention is embodied in an adjustable toilet 10 which comprises a fresh water supply unit 12 which includes a tank 14 fixed to a support W, such as a wall or the like, a fresh water inlet connection 16 on the tank 14 fluidically connecting the tank 14 to a source of fresh water FW, and a fluid outlet connection 18 on tank 14 for purposes that will be understood from the teaching of the following disclosure. The fresh water supply unit 12 further includes a flexible fresh water fluid conduit 20 having an inlet end 22 fluidically connected to the fluid outlet connection 18 on tank 14 and an outlet end 24. The function of flexible conduit 20 will be understood from the teaching of the following disclosure. A flush control system 26 on the tank includes a handle 28 and operates and functions in a manner known to those skilled in the art and thus will not be further discussed.

Adjustable toilet 10 further includes a waste water control system 30 which includes a drain conduit 32 fixed to a floor F and having an outlet end 34 fluidically connected to a waste water receiving system WW and an inlet end 36. A flexible waste water fluid conduit 38 has an outlet end 40 fluidically connected to inlet end 36 of drain conduit 32 of waste water control system 30, and an inlet end 42. The flexible conduits 20 and 38 permit adjustable toilet 10 to be retrofit to an existing toilet system.

Adjustable toilet 10 further includes a toilet bowl unit 50 which includes a water-storing bowl 52 having a fresh water inlet 54 on water-storing bowl 52. Fresh water inlet 54 is fluidically connected to outlet end 24 of flexible fresh water fluid conduit 20 of fresh water supply unit 12. A waste water outlet 56 is on the water-storing bowl 52 and is fluidically connected to inlet end 42 of flexible waste water fluid conduit 38 of waste water control system 30. Water-storing bowl 52 has an outside surface 58. The toilet bowl unit further includes a toilet bowl seat 60 movably attached to water-storing bowl 52 and a toilet bowl cover 62 is also movably attached to the water-storing bowl 52.

Adjustable toilet 10 further includes a toilet bowl support system 70 which includes a plurality of spaced apart individually adjustable toilet bowl lifting mechanisms, such as toilet bowl lifting mechanism 72. The toilet bowl lifting mechanisms 72 are independent of each other and can be operated independently of each other so water-storing bowl 52 can be tilted to an oblique angle with respect to floor F, such as with front portion 74 of bowl 52 closer to floor F than rear portion 76 of bowl 52. Side portions of the bowl can also be tilted with respect to the floor as well as will be understood by one skilled in the art based on the teaching of this disclosure. Such tilting permits a physically challenged person to more easily sit on seat 60 than if such a person had to lift himself or herself completely above seat 60 as may be the case if seat 60 remains in a plane that is parallel to the plane of floor F. The bowl can also be lowered as necessary or raised as necessary by means of the lifting mechanism 70.

As shown in FIGS. 1 and 2, all toilet bowl lifting mechanisms 72 are identical. Accordingly, only one toilet bowl lifting mechanism 72 will be described, it being understood that the description applies to each of the toilet bowl lifting mechanisms 72 shown in FIGS. 1 and 2. It is also noted that while three lifting mechanisms 72 are shown in FIGS. 1 and 2, more or fewer lifting mechanisms 72 could be used without departing from the scope of the present disclosure.

Figure 3:
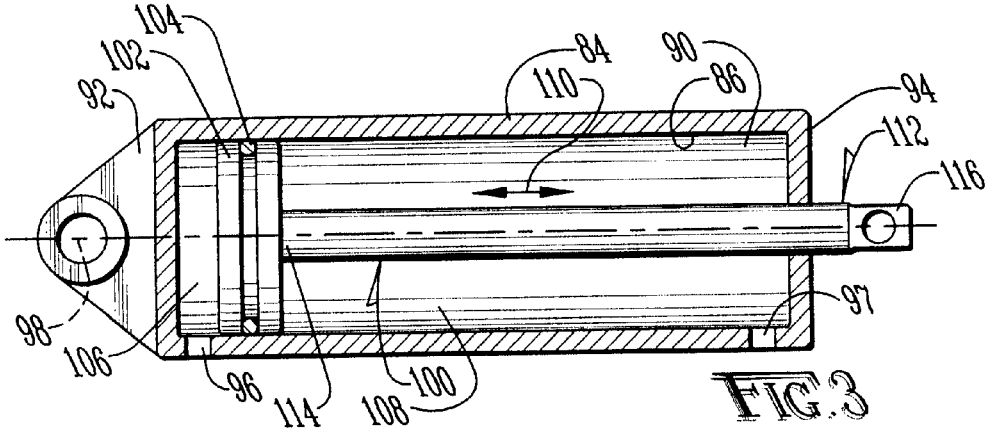
FIG. 3 is a cutaway view of a hydraulic cylinder mechanism used in the toilet bowl support system of the present invention.

As shown in FIGS. 1, 2 and 3, each toilet bowl lifting mechanism 72 includes a foot mount 80 fixedly mounted on floor F adjacent to water-storing bowl 52 of toilet bowl unit 50, a head mount 82 fixedly mounted on outside surface 58 of water-storing bowl 52 of toilet bowl unit 50, a hollow cylindrical housing 84 located between foot mount 80 and head mount 82 of each toilet bowl lifting mechanism 72 and having an inside surface 86, a chamber 90 defined by inside surface 86 of hollow cylindrical housing 84. Housing 84 includes a fore end 92 located adjacent to head mount 82, an aft end 94 located adjacent to foot mount 80 in the set-up configuration shown in the Figures. A first fluid connection 96 is located on hollow cylindrical housing 84 adjacent to fore end 92 and is fluidically connected to chamber 90 defined in hollow cylindrical housing 84, and a second fluid connection 97 is located on hollow cylindrical housing 84 adjacent to aft end 94 and is fluidically connected to chamber 90. Housing 84 has a longitudinal axis 98 extending between fore end 92 and aft end 94.

A piston unit 100 is mounted in housing 84 of each toilet bowl lifting mechanism 72 and includes a piston head 102 in chamber 90 of the housing 84 of each toilet bowl lifting mechanism 72 and slidably engages inside surface 86 of the hollow housing 84, such as by O-rings such as O-ring 104. Chamber 90 is divided by piston head 102 into a first chamber portion 106 located between piston head 102 and fore end 92 of housing 84 and a second chamber portion 108 located between piston head 102 and aft end 94 of housing 84. Piston head 102 is movable in chamber 90 along longitudinal axis 98 of housing 84 between a first position adjacent to fore end 92 of hollow housing 84 as shown in FIG. 3 and a second position adjacent to aft end 94 of hollow housing 84 in directions 110 as indicated by the double-headed arrow shown in FIG. 3. Each piston unit further includes a piston rod 112 having a first end 114 connected to piston head 102 for movement therewith and a second end 116 located outside of the hollow housing chamber 90.

Piston rod 112 slidably extends through aft end 94 of the hollow housing 84 so chamber 90 remains fluid tight.

Each toilet bowl lifting mechanism 72 further includes a first pivot pin 120 pivotably connecting head end 92 of each toilet bowl lifting mechanism 72 to one of the head mounts 82 fixedly mounted on outside surface 58 of water-storing bowl 52 of toilet bowl unit 50, and a second pivot pin 124 pivotally connects second end 114 of piston rod 112 of each toilet bowl lifting mechanism 72 to one of the foot mounts 80 fixedly mounted on floor F adjacent to water-storing bowl 52 of toilet bowl unit 50.

Figure 4:
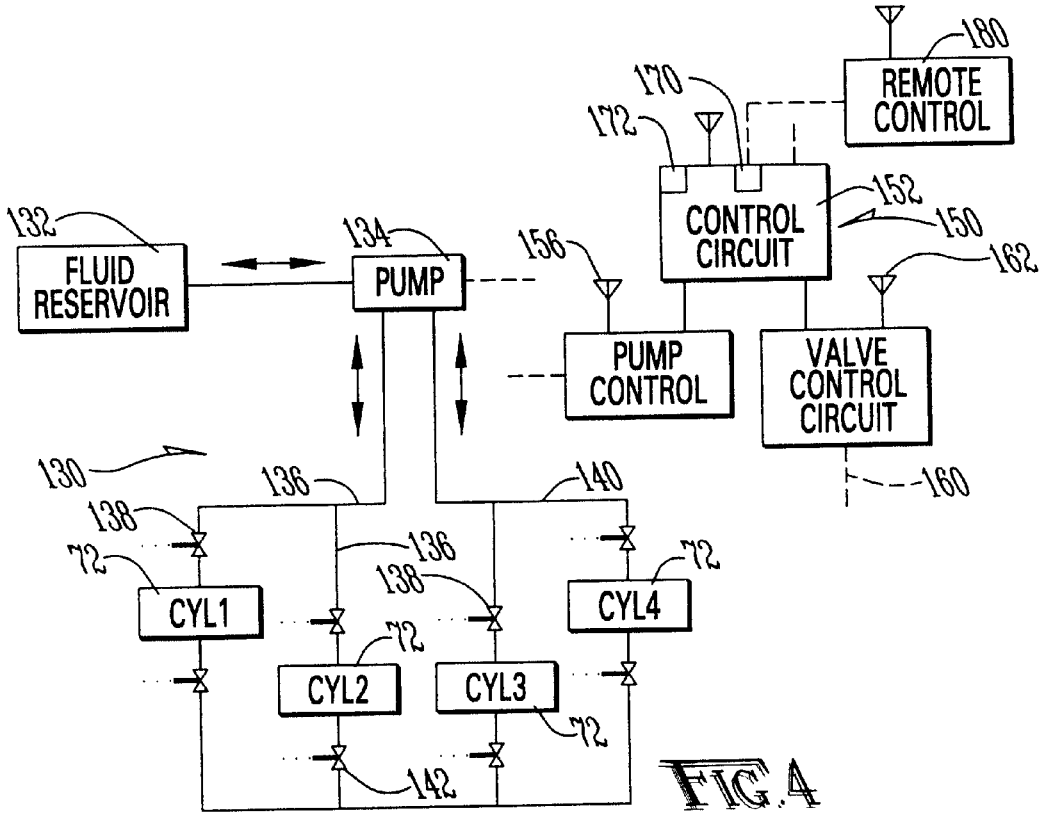
FIG. 4 is a schematic of a fluid circuit used to control the toilet bowl support system of the present invention.

The toilet bowl lifting system 70 further includes a hydraulic fluid control circuit 130 shown in FIG. 4. Circuit 130 can be located beneath floor F or in any other convenient location. Circuit 130 is fluidically connected to each toilet bowl lifting mechanism 72 and includes a source of hydraulic fluid, such as a reservoir 132, a pump 134 fluidically connected to a source of hydraulic fluid 132, a first hydraulic fluid conduit 136 fluidically connecting pump 134 to first fluid connection 96 on the hollow housing 84 of each toilet bowl lifting mechanism 72. A first hydraulic fluid flow control valve 138 is in each first hydraulic fluid conduit 136 and is located fluidically between pump 134 and first fluid connection 96 on hollow housing 84 of each toilet bowl lifting mechanism 72. First hydraulic fluid flow control valve 138 is movable between a closed fluid blocking configuration and an open fluid permitting configuration to control the flow of fluid in conduit 136 to and from housing 84 as will be understood from the teaching of the present disclosure. Hydraulic fluid flow control circuit 130 further includes a second hydraulic fluid conduit 140 fluidically connecting second fluid connection 97 on hollow housing 84 of each toilet bowl lifting mechanism 72 to pump 134. Due to the parallel circuit arrangement as shown in FIG. 4, conduit 136 is identified for each mechanism 72. A second hydraulic fluid flow control valve 142 is in each second hydraulic fluid conduit 140 and is located fluidically between second fluid connection 97 on hollow housing 84 of each toilet bowl lifting mechanism 72 and pump 134. The second hydraulic fluid flow control valve 142 is movable between a closed fluid blocking configuration and an open fluid permitting configuration thereby controlling flow in conduit 140.

Figure 5:
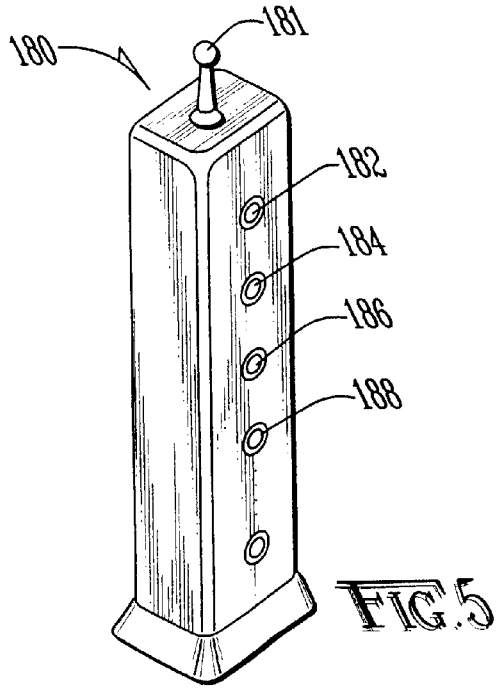
FIG. 5 is a perspective view of a remote control unit used in the adjustable toilet of the present invention.

Hydraulic fluid control circuit 130 further includes a control circuit 150 which includes a pump control circuit 152 electrically associated with pump 134 either via a land line 154 or via over-the-air communication as indicated by a circuit 156, a hydraulic valve control circuit 158 electrically associated with the first and second hydraulic valve 138 and 142 in each toilet bowl lifting mechanism 72 of the plurality of toilet bowl lifting mechanisms 72 either via a land line 160 or via over-the-air communication as indicated by a circuit 162. Control circuit 150 further includes a signal receiver circuit 170 which can be either via land line or via over-the-air and a signal transmitter circuit 172 which can be via land line or via over-the-air. A remote control unit 180 is associated with control circuit 150 of the hydraulic fluid control circuit and is located near the water-storing bowl 52 of the toilet bowl unit 50. Remote control unit 180 can be associated with the control circuit either via land line or via over-the-air communications as indicated by antenna 181. The remote control unit is shown in FIGS. 4 and 5 and includes a plurality of control buttons, such as button 182, 184 and 186, each control button being associated with one toilet bowl lifting mechanism 72 of the plurality of toilet bowl lifting mechanisms 72, and an on/off switch 188 connecting the hydraulic valve control circuit to a source of power when in an ON configuration. Other buttons can also be included as desired for other operations, or one button can be an ON signal light. It is noted that both land line and over-the-air communication are indicated in FIG. 4 for each element of control circuit 130 for the sake of convenience. It is not necessary to use both forms of communication.

It is understood that while certain forms of the present invention have been illustrated and described herein, it is not to be limited to the specific forms or arrangements of parts described and shown.

I claim:

1. An adjustable toilet comprising:

a) a fresh water tank fixed to a support;

b) a waste water conduit fixed to a floor;

c) a toilet bowl having a fresh water inlet and a waste water outlet;

d) a flexible fresh water conduit fluidically connecting said fresh water tank to the fresh water inlet of said toilet bowl;

e) a flexible waste water conduit fluidically connecting the waste water outlet of said toilet bowl to said waste water conduit;

f) a toilet bowl support system including a plurality of individually adjustable toilet bowl supports each of which has one end attached to the floor and another end attached to the toilet bowl; and g) a control circuit associated with each of the individually adjustable toilet bowl supports to move each toilet bowl support independently of other toilet bowl supports to move said toilet bowl in a plurality of planes and to tilt said toilet bowl with respect to the floor into an oblique angle with respect to the floor.

2. An adjustable toilet comprising:

a) a fresh water tank fixed to a support;

b) a waste water conduit fixed to a floor;

c) a toilet bowl having a fresh water inlet and a waste water outlet;

d) a flexible fresh water conduit fluidically connecting said fresh water tank to the fresh water inlet of said toilet bowl;

e) a flexible waste water conduit fluidically connecting the waste water outlet of said toilet bowl to said waste water conduit;

f) a toilet bowl support system including (1) a plurality of spaced apart individually adjustable toilet bowl lifting mechanisms, each toilet bowl lifting mechanism including (A) a hydraulic cylinder having (i) a hollow housing having an inside surface and a chamber defined by the inside surface, (ii) a first hydraulic fluid connection on the hollow housing, and (iii) a second hydraulic fluid connection on the hollow housing, (B) a piston head movably located in the hollow housing and slidably engaging the inside surface of the hollow housing and dividing the chamber of the hollow housing into two chamber sections, (C) a piston rod having one end connected to the piston head and extending out of the hollow housing and having a second end located outside the hollow housing, (D) a floor pivot mount fixedly mounted on the floor adjacent to said toilet bowl, (E) a floor pivot connection pivotably connecting the second end of the piston rod to the floor pivot mount, (F) a toilet bowl pivot connection pivotably connecting the hollow housing to the toilet bowl, (2) a hydraulic fluid circuit which includes (A) a reservoir of hydraulic fluid, (B) a pump fluidically connected to the reservoir, (C) a first hydraulic fluid conduit system fluidically connecting the pump to the first hydraulic fluid connection of the hollow housing of each toilet bowl lifting mechanism, (D) a first hydraulic fluid flow control valve in each first hydraulic fluid conduit and located fluidically between the pump and the hollow housing, (E) a second hydraulic fluid conduit system fluidically connecting the second hydraulic fluid connection of the hollow housing of each toilet bowl lifting mechanism to the pump, and (F) a second hydraulic fluid flow control valve in each second hydraulic fluid conduit and located fluidically between the hollow housing and the pump, and (3) a control circuit electrically associated the pump and to each hydraulic fluid control valve and includes a remote control unit.

3. An adjustable toilet comprising:

a) a fresh water supply unit which includes (1) a tank fixed to a support, (2) a fresh water inlet connection on the tank fluidically connecting the tank to a source of fresh water, (3) a fluid outlet connection on the tank, (4) a flexible fresh water fluid conduit having an inlet end fluidically connected to the fluid outlet connection on the tank and an outlet end, and (5) a flush control system on the tank;

b) a waste water control system which includes (1) a drain conduit fixed to a floor and having an outlet end fluidically connected to a waste water receiving system and an inlet end, and (2) a flexible waste water fluid conduit having an outlet end fluidically connected to the inlet end of the drain conduit of said waste water control system, and an inlet end;

c) a toilet bowl unit which includes (1) a water-storing bowl having (A) a fresh water inlet on the water-storing bowl, the fresh water inlet being fluidically connected to the outlet end of the flexible fresh water fluid conduit of said fresh water supply unit, and (B) a waste water outlet on the water-storing bowl, the waste water outlet being fluidically connected to the inlet end of the flexible waste water fluid conduit of said waste water control system, and (C) an outside surface on the water-storing bowl, (2) a toilet bowl seat movably attached to the water-storing bowl, and (3) a toilet bowl cover movably attached to the water-storing bowl; and d) a toilet bowl support system which includes (1) a plurality of spaced apart individually adjustable toilet bowl lifting mechanisms, each toilet bowl lifting mechanism including (A) a foot mount fixedly mounted on a floor adjacent to the water-storing bowl of said toilet bowl unit, (B) a head mount fixedly mounted on the outside surface of the water-storing bowl of said toilet bowl unit, (C) a hollow cylindrical housing located between the foot mount and the head mount of each toilet bowl lifting mechanism and having (i) an inside surface, (ii) a chamber defined by the inside surface of the hollow cylindrical housing, (iii) a fore end located adjacent to the head mount, (iv) an aft end located adjacent to the foot mount, (v) a first fluid connection on the hollow cylindrical housing adjacent to the fore end and fluidically connected to the chamber defined in the hollow cylindrical housing, (vi) a second fluid connection on the hollow cylindrical housing adjacent to the aft end and fluidically connected to the chamber defined in the hollow cylindrical housing, (vii) a longitudinal axis extending between the fore end and the aft end of the housing of each toilet bowl lifting mechanism, (D) a piston unit mounted in the housing of each toilet bowl lifting mechanism and including (i) a piston head in the chamber of the housing of each toilet bowl lifting mechanism and slidably engaging the inside surface of the hollow housing, the chamber being divided into a first chamber portion located between the piston head and the fore end of the housing and a second chamber portion located between the piston head and the aft end of the housing, (ii) the piston head being movable in the chamber along the longitudinal axis of the housing between a first position adjacent to the fore end of the hollow housing and a second position adjacent to the aft end of the hollow housing, and (iii) a piston rod having a first end connected to the piston head for movement therewith and a second end located outside of the hollow housing chamber, the piston rod slidably extending through the aft end of the hollow housing, (D) a first pivot pin pivotably connecting the head end of each toilet bowl lifting mechanism to one of the head mounts fixedly mounted on the outside surface of the water-storing bowl of said toilet bowl unit, and (E) a second pivot pin pivotably connecting the second end of the piston rod of each toilet bowl lifting mechanism to one of the foot mounts fixedly mounted on the floor adjacent to the water-storing bowl of said toilet bowl unit, and (2) a hydraulic fluid control circuit fluidically connected to each toilet bowl lifting mechanism and including (A) a source of hydraulic fluid, (B) a pump fluidically connected to the source of hydraulic fluid, (C) a first hydraulic fluid conduit fluidically connecting the pump to the first fluid connection on the hollow housing of each toilet bowl lifting mechanism, (D) a first hydraulic fluid flow control valve in each first hydraulic fluid conduit and located fluidically between the pump and the first fluid connection on the hollow housing of each toilet bowl lifting mechanism, the first hydraulic fluid flow control valve being movable between a closed fluid blocking configuration and an open fluid permitting configuration, (E) a second hydraulic fluid conduit fluidically connecting the second fluid connection on the hollow housing of each toilet bowl lifting mechanism to the pump, (F) a second hydraulic fluid flow control valve in each second hydraulic fluid conduit and located fluidically between the second fluid connection on the hollow housing of each toilet bowl lifting mechanism and the pump, the second hydraulic fluid flow control valve being movable between a closed fluid blocking configuration and an open fluid permitting configuration, (G) a control circuit which includes (i) a pump control circuit electrically associated with the pump, (ii) a hydraulic valve control circuit electrically associated with the first and second hydraulic valves in each toilet bowl lifting mechanism of the plurality of toilet bowl lifting mechanisms, (iii) a signal receiver circuit, and (iv) a signal transmitter circuit, and (H) a remote control unit associated with the control circuit of the hydraulic fluid control circuit and located near the water-storing bowl of said toilet bowl unit and including (i) a plurality of control buttons, each control button being associated with one toilet bowl lifting mechanism of the plurality of toilet bowl lifting mechanisms, and (ii) an on/off switch connecting the hydraulic valve control circuit to a source of power when in an ON configuration.

4. The adjustable toilet as described in claim 3 further including a fluid control unit mounted on the tank of said fresh water supply unit.

* * * * *